United States Patent [19]

Schmitt

[11] Patent Number: 4,822,950

[45] Date of Patent: Apr. 18, 1989

[54] NICKEL/CARBON FIBER BRAIDED SHIELD

[76] Inventor: Richard J. Schmitt, 5 Linda Rd., Port Washington, N.Y. 11050

[21] Appl. No.: 125,190

[22] Filed: Nov. 25, 1987

[51] Int. Cl.[4] ..... H01B 7/34

[52] U.S. Cl. ..... 174/36; 174/109; 428/367

[58] Field of Search ..... 174/36, 109; 428/367

[56] References Cited

U.S. PATENT DOCUMENTS

| | | | |
|---|---|---|---|
| 2,258,222 | 10/1941 | Rochow | 174/110 A |
| 2,337,556 | 12/1943 | Hosking | 174/108 |
| 3,594,491 | 7/1971 | Zeidlhack | 174/36 |
| 4,145,475 | 3/1979 | Vostovich | 174/110 AR X |
| 4,314,737 | 2/1982 | Bogese et al. | 174/36 X |
| 4,477,693 | 10/1984 | Krabec et al. | 174/36 |
| 4,518,632 | 5/1985 | Jones | 428/367 X |
| 4,594,472 | 6/1986 | Brettle et al. | 174/35 MS |
| 4,634,805 | 1/1987 | Orban | 174/128 R |
| 4,661,403 | 4/1987 | Morin | 428/408 X |
| 4,684,762 | 8/1987 | Gladfelter | 174/36 |

*Primary Examiner*—Morris H. Nimmo
*Attorney, Agent, or Firm*—Klauber & Jackson

[57] ABSTRACT

An electrical assembly for transmitting signals having a wire or cable conductor core, an electrically-insulating jacket surrounding and enveloping the core, and a surrounding braided shield formed from yarns of nickel-plate carbon fibers. Typically each fiber has a diameter of 5–10 microns and the yarn contains 800 to 12,000 fibers.

5 Claims, 1 Drawing Sheet

NICKEL/CARBON FIBER BRAIDED SHIELD

FIELD OF THE INVENTION

This invention relates to braided shields for wires and cables.

BACKGROUND OF THE INVENTION

Wires and cables and like conductors used for the transmission of radio frequency signals and signals of other frequencies suffer from well-known interference problems. Essential to the control of such interference in electrical wire and cable conductor systems is the ability to provide shielding. Actually, such wires and cables may transmit interference, which must be contained, while at the same time they may pick up interference from outside sources, e.g., from other electronic devices. Consequently, since all wire and cable, when in use, is a potential source of electrical noise, a means of containing these bothersome emissions is important if the wire and cable are to perform efficiently and effectively.

In addition, wire and cable conductors are affected by many external sources such as motors, office equipment, fluorescent lights, other unshielded wires and cables, power transmission lines, cellular phones and numerous other sources.

Wire and cable have been proposed and are available with shielded systems which are based on metal, such as copper.

Since practically all of the wire and cable applications require some degree of flexibility, especially when installing the wires and cables into a network or system, shielding materials must not adversely affect the desired flexibility. As a result, solid metal forms, which might, indeed, provide excellent shielding, e.g., tubing, cannot be used for most purposes. Consequently, current practice permits the use of braided metal wires around the conductive core. The metal wires most commonly used for this purpose are copper, tin-plated copper, nickel-plated copper, and silver-plated stainless steel. The braid configuration depends upon the frequencies involved. For example, copper spiral wrapping is poor for frequencies above 100 KHz, whereas braided copper strands provide shielding of relatively good efficiency in that range. It is also important that the shielding be capable of grounding effectively.

While, therefore, braided shields heretofore used are relatively effective, they generally tend to suffer from one or more disadvantages. For example, they may be undesirably heavy, lack sufficient flexibility, have poor fatigue resistance, and be susceptible to breaking under certain circumstances.

It is, accordingly, an object of the present invention to provide a braided shield for wire and cable conductors which avoids the drawbacks and disadvantages of braided shields heretofore employed.

It is another object of the invention to provide a braided shield of the character indicated, which is relatively light in weight, has high flexibility, enjoys good fatigue resistance, and is free from a tendency to break.

It is a further object of the invention to provide a composite conductor assembly which includes an improved braided shield.

SUMMARY OF THE INVENTION

In accordance with the invention, efficient, flexible braided shields for wire and cable are provided by braiding "tows" or yarns composed of nickel-plated carbon fibers. Thus, a wire or cable, suitably insulated, has braided upon it a braided shield composed of yarns formed from nickel-plated carbon fibers.

BRIEF DESCRIPTION OF THE DRAWING

The foregoing objects and features of the invention will be readily apparent from the following detailed description of illustrative embodiments thereof, and from the drawing, wherein.

DESCRIPTION OF THE PREFERRED EMBODIMENTS

Figure 1:
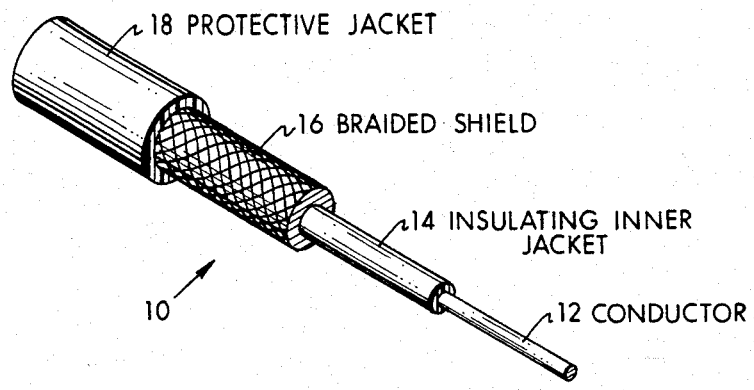
FIG. 1 is a side elevation of a wire conductor assembly, cut away to show details of construction, provided with a braided shield embodying features of the present invention.

Referring now to FIG. 1, the composite conductor assembly 10 is composed of a wire or cable conductor 12, e.g., of copper, which is provided with an insulating inner jacket 14.

The surrounding non-conductive insulating jacket or sleeve 14 preferably comprises an elastomeric silicone, polyurethane, PVC, or the like, which has been suitably extruded in conventional manner to enclose the conductor 12. Surrounding the insulating inner jacket 14 is a braided shield 16 formed, in accordance with the invention, of braided yarns of nickel-plated carbon fibers.

The nickel plating of carbon fibers is a well-known procedure and various processes for doing so have been described such as, for example, vacuum deposition, electroless deposition and electrolytic deposition but, for the purposes of this invention, the nickel-plated fibers are preferably prepared by the process described in Morin, U.S. Pat. No. 4,661,403 of Apr. 28, 1987, the disclosure of which is incorporated herein by reference.

Thus, the nickel-plated carbon fibers used in accordance with this invention are typically produced by:

(a) providing a continuous length of a plurality of carbon core fibers;

(b) immersing at least a portion of the length of said fibers in a bath capable of electrolytically depositing nickel;

(c) applying an external voltage between the fibers and the bath in excess of that which is sufficient (i) to dissociate the nickel and (ii) to uniformly nucleate the dissociated nickel through any barrier layer onto the surface of said fibers; and (d) maintaining said voltage for a time sufficient to produce a thin, uniform, firmly adherent, electrically conductive layer of electrolytically-deposited nickel on said core, the bond strength of said layer to said core being not substantially less than about 10 percent of the tensile strength of the nickel.

Figure 2:
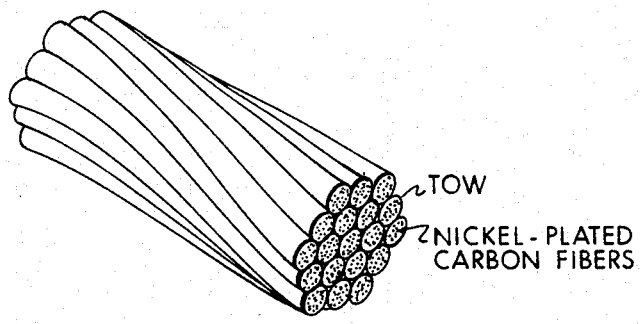
FIG. 2 is an enlarged fragmentary view, partly in section of spun tows or yards of nickel-plated carbon fibers.

The nickel-plated fibers are obtained in the process U.S. patent 4,661,403 in the form of "tows" or yarns, which are bundles of fibers and each tow comprises some 12,000 fibers. The individual nickel-plated fibers in the tows ordinarily have a fiber diameter of 5 to 10 microns. The tows as obtained from the Morin nickel-plating process are preferably subdivided into smaller tows or yarns of about 300 to 1000 fibers each, and it is either the original tows or these smaller tows of nickel-plated carbon fibers that are used to form spun yarns which are braided into braided shields for wire and cable conductors, all in accordance with the invention, whereby the fiber bundles braided comprise, e.g., 800 to 12,000 nickel-plated fibers, see FIG. 2. It is preferred that the braiding of the spun tows or yarns around the insulated wire be relatively "tight" i.e., a relatively high number of strands per inch. The tightness of braid is selected according to the frequency range. Weave angle, number of strands, and coverage is readily selected to accommodate particular use requirements.

Braiding over the insulated wire or cable conductor is readily effected by conventional procedures.

Referring again to FIG. 1, the assembly 10 is completed by applying a protective outer jacket 18 over the braided shield 16. The outer jacket 18 can be formed from any thermoplastic resin of relatively good wear resistance, such as PVC, which can be extruded over the braided shield 16.

Thus, a typical composite shielded conductor assembly in accordance with the invention comprises, as mentioned, an electrically-conductive wire or cable central core which is surrounded by an electrically-insulating jacket, which preferably comprises polyurethane, which is co-extruded with the central conductive core. The jacket may also however, as mentioned, comprise other electrically-insulating elastomeric materials, such as a butadiene-styrene rubber, a chlorosulfonated polyethylene, and the like. The insulating jacket has a relatively much larger diameter than the central core. Surrounding the insulating jacket is the unique flexible shield of braided yarn of nickel-plated carbon fibers and the whole is then enclosed in a protective outer jacket.

There is thus provided an electrically-conductive assembly which includes a highly flexible braided shield which is highly effective against interference.

The shield of yarn of nickel-plated carbon fibers in accordance with the invention has a significant combination of advantages not shared by prior art shields, e.g., 1. Significant weight reduction.

2. Many thousands of individual fibers working in tandem provide superior flexibility which is necessary for positioning over and under small radii and into small openings.

3. The combination of the light-weight fiber center and the nickel coating of approximately 0.5 micron in thickness contributes the isothropic conductivity and low contact resistance necessary for termination and magnetic properties to enhance shielding effectiveness.

4. The small diameter of individual fibers provides superior surface area coverage and substantially reduces the susceptibility to opening gaps when 90°+bends are applied.

5. High temperature resistance.

It will be apparent that various changes and modifications may be made without departing from the scope of the invention as defined in the appended claims. It is intended, therefore, that all matter contained in the foregoing description and in the drawing shall be interpreted as illustrative only and not in a limiting sense.

I claim:

1. A shielded electrical conductor unit for transmitting electrical signals, comprising a composite having an electrically-conductive cable core, an electrically-insulating elastomeric jacket surrounding and enveloping said core, and a braided shield surrounding and enveloping said insulating jacket, said braided shield being formed from spun yarns of nickel-plated carbon fibers.

2. A shielded electrical conductor unit for transmitting electrical signals as defined in claim 1, wherein each individual fiber in said braided shield has a diameter of from 5 to 10 microns.

3. A shielded electrical conductor unit for transmitting electrical signals as defined in claim 1, wherein each yarn in said braided shield has from 800 to 12,000 fibers.

4. A method of transmitting an electrical signal with concurrent suppression of interference which comprises transmitting said current through a conductor unit comprising a composite having an electrically-conductive cable core, an electrically-insulating elastomeric jacket surrounding and enveloping said core, and a braided shield surrounding and enveloping said insulating jacket, said braided shield being formed from spun yarns of nickel-plated carbon fibers.

5. A conductor for transmitting electrical signals, said conductor being shielded from interference by a braided shield formed from spun yarn of nickel-plated carbon fiber surrounding and enveloping said conductor.

* * * * *